US008010591B2

(12) United States Patent
Mojarradi et al.

(10) Patent No.: US 8,010,591 B2
(45) Date of Patent: Aug. 30, 2011

(54) FOUR-GATE TRANSISTOR ANALOG MULTIPLIER CIRCUIT

(75) Inventors: Mohammad M. Mojarradi, La Canada, CA (US); Benjamin Blalock, Knoxville, TX (US); Sorin Cristoloveanu, Seyssinet-Pariset (FR); Suheng Chen, Knoxville, TN (US); Kerem Akarvardar, Palo Alto, CA (US)

(73) Assignee: California Institute of Technology, Pasadena, CA (US)

( * ) Notice: Subject to any disclaimer, the term of this patent is extended or adjusted under 35 U.S.C. 154(b) by 1102 days.

(21) Appl. No.: 11/804,893

(22) Filed: May 21, 2007

(65) Prior Publication Data

US 2008/0001658 A1 Jan. 3, 2008

Related U.S. Application Data

(60) Provisional application No. 60/801,875, filed on May 19, 2006.

(51) Int. Cl.
*G06E 3/00* (2006.01)

(52) U.S. Cl. ..... 708/839
(58) Field of Classification Search ..... 708/835; 327/356–357
See application file for complete search history.

(56) References Cited

U.S. PATENT DOCUMENTS 5,523,717 A * 6/1996 Kimura ..... 330/252
5,581,210 A * 12/1996 Kimura ..... 327/355
5,712,810 A * 1/1998 Kimura ..... 708/835

OTHER PUBLICATIONS

Akarvardar et al, "A Novel Four-Qadrant Analog Multiplier Using SOI Four-Gate Transistors (G-FETs)", Pasadena, CA: Jet Propulsion Laboratory, National Aeronautics and Space Administration, Sep. 2005.*
Akarvardar, Kerem, et al., "Depletion-All-Around Operation of the SOI Four-Gate Transistor", *IEEE Transactions on Electron Devices*, vol. 54, No. 2, (323-331), (Jan. 2007), 9.
Cristoloveanu, Sorin, et al., "A Review of the SOI Four-Gate Transistor", *IEEE*, (2006), 4.

* cited by examiner

*Primary Examiner* — Tan V Mai
(74) *Attorney, Agent, or Firm* — Milstein Zhang & Wu LLC; Joseph B. Milstein

(57) ABSTRACT

A differential output analog multiplier circuit utilizing four $G^4$-FETs, each source connected to a current source. The four $G^4$-FETs may be grouped into two pairs of two $G^4$-FETs each, where one pair has its drains connected to a load, and the other par has its drains connected to another load. The differential output voltage is taken at the two loads. In one embodiment, for each $G^4$-FET, the first and second junction gates are each connected together, where a first input voltage is applied to the front gates of each pair, and a second input voltage is applied to the first junction gates of each pair. Other embodiments are described and claimed.

20 Claims, 4 Drawing Sheets

FOUR-GATE TRANSISTOR ANALOG MULTIPLIER CIRCUIT

BENEFIT OF PROVISIONAL APPLICATION

This patent application claims the benefit of Provisional Application No. 60/801,875, filed 19 May 2006.

GOVERNMENT INTEREST

The invention described herein was made in the performance of work under a NASA contract, and is subject to the provisions of Public Law 96-517 (35 USC 202) in which the Contractor has elected to retain title.

FIELD

The present invention relates to analog circuits, and more particularly, to analog multiplier circuits utilizing four-gate transistors.

BACKGROUND

Analog multiplier circuits are useful building blocks in many analog applications, such as signal processing. Typical analog multiplier circuits, such as the so-called Gilbert multiplier, use on average from six to ten transistors for a differential output.

DESCRIPTION OF EMBODIMENTS

In the description that follows, the scope of the term "some embodiments" is not to be so limited as to mean more than one embodiment, but rather, the scope may include one embodiment, more than one embodiment, or perhaps all embodiments.

Embodiments described herein use a four-gate FET (Field Effect Transistor) as a basic building block in analog multiplier circuits. Four such four-gate FETs are employed to form a differential output multiplier. (Two such four-gate FETs may be employed to form a single-ended output multiplier.) The four-gate FET, denoted as $G^4$-FET, has been described in various publications, such as for example in B. J. Blalcok, et al., "The Multiple-Gate MOS-JFET Transistor", Int. Journal of High Speed Electronics and Systems, 12 (2), pp. 511-520, 2002; and in K. Akarvardar, et al., "Depletion-All-Around Operation of the SOI Four-Gate Transistor," IEEE Trans. on Electron Devices, vol. 54, no. 2, Feb., 2007, pp. 323-331. A $G^4$-FET is a SOI (Silicon-On-Insulator) device.

Figure 1A:
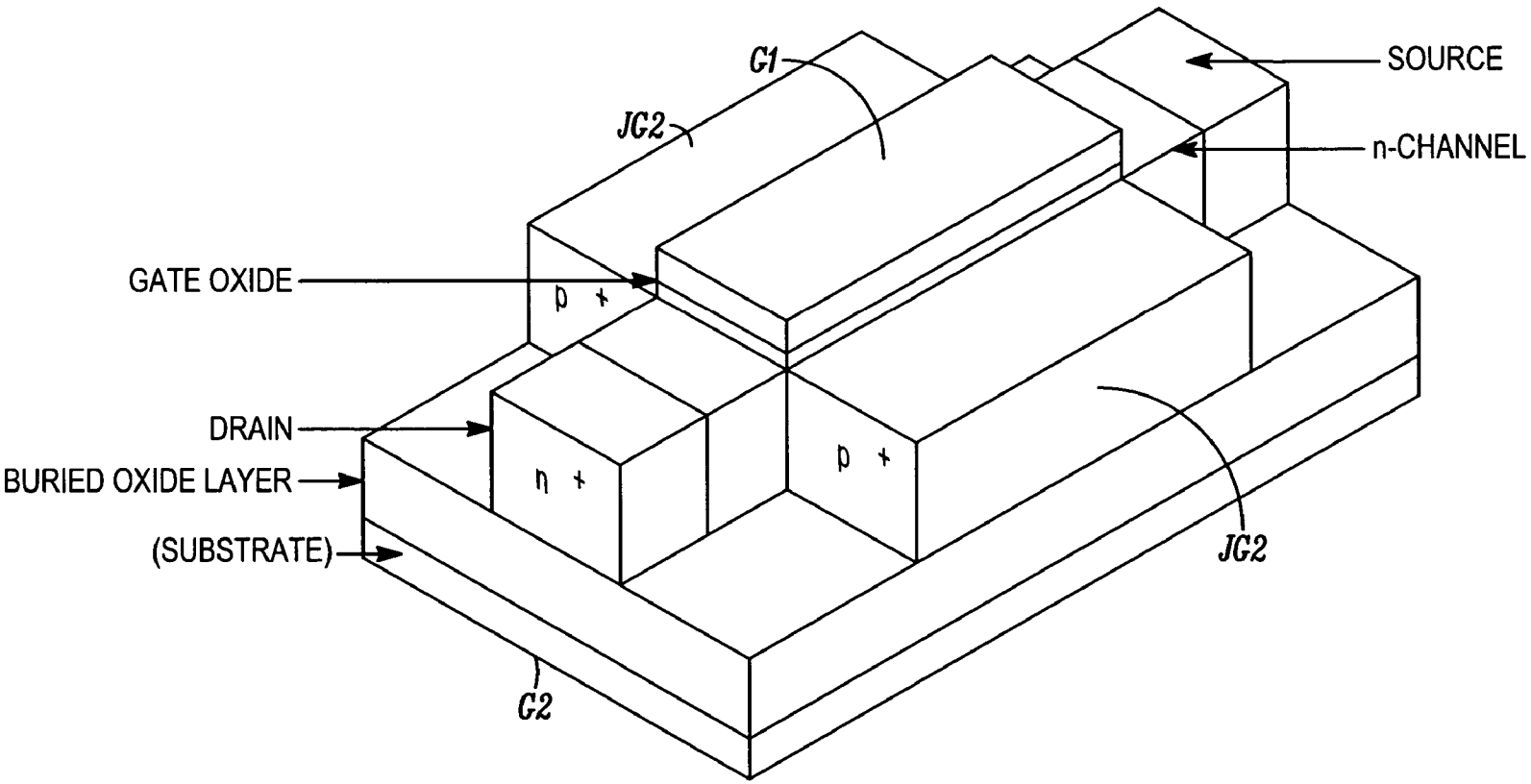
(PRIOR ART) FIG. 1A
FIG. 1A is a prior art illustration of a $G^4$-FET.

FIG. 1A illustrates a simplified perspective view of an n-channel $G^4$-FET. The n-channel, source, and drain are labeled as such in FIG. 1A. For an n-channel $G^4$-FET, the channel is doped n, and the source and drains are doped $n^+$. Above the n-channel is a gate oxide, labeled as such, and on top of the gate oxide is a gate, labeled G1 for the "first" gate, which may be polysilicon. This gate will also be referred to as a front gate. A buried oxide layer, labeled as such, is below the n-channel, source, and drain. Below the buried oxide layer is a substrate, labeled as such. The substrate also serves as the "second" gate, and so is labeled as G2. This gate will also be referred to as a back gate. Two junction gates, labeled JG1 and JG2, are doped $p^+$. A p-channel $G^4$-FET is complementary to an n-channel $G^4$-FET, in that the channel is doped p, the source and drains are doped $p^+$, and the junction gates are doped $n^+$.

From FIG. 1A, it is seen that a $G^4$-FET may be viewed as an accumulation-mode MOSFET featuring two lateral junction-gates (JG1 and JG2). Alternatively, it may be viewed as a lateral double-gate JFET (Junction FET) featuring two vertical MOS (Metal Oxide Semiconductor) gates (polysilicon front gate G1 and substrate-emulated back-gate G2). The junction gates are normally reverse biased with respect to the channel, and the drain-current $I_D$ is comprised of majority carriers. The structure and layout of an n-channel $G^4$-FET may be essentially the same as that of a p-channel inversion-mode SOI MOSFET with two body contacts on each side of the channel. The body contacts, source, and drain of the inversion-mode MOSFET are used in the $G^4$-FET as the source, drain, and junction gates, respectively. The four-gates of the $G^4$-FET may be independently biased. Depending on the biasing, source and (or) volume conduction modes are available.

The junction gates operate as in a JFET, altering the potential distribution within the body via the lateral depletion regions they induce. On a partially depleted body, if the reverse bias on the junction gates is sufficiently high, they can switch the $G^4$-FET from a normally ON mode to a normally OFF mode. Further increases in the magnitude of the junction gate voltages modulate the threshold voltage related to the front gate (G1). In a normally OFF mode, the saturated drain current of the $G^4$-FET may be expressed as for an accumulation-mode MOSFET by including the threshold voltage modulation by the junction gates:

$$I_D = \frac{K_n}{2}[V_{G1S} - V_T(V_{JG1S}, V_{JG2S})]^2, \tag{1}$$

where $K_n$ is the transconductance parameter given by, $$K_n = \frac{W_{eff}}{L} C_{OX} \mu_{neff}, \tag{2}$$

$C_{OX}$ is the front gate oxide capacitance, $\mu_{neff}$ is the effective electron mobility, and $W_{eff}$ is the effective channel width, which is about half of the distance between the two junctions due to the squeezing effect of the junction gates. In the above expressions, the subscript S in the voltages denotes that they are respect to the source. For example, $V_{JG1S}$ is the gate-to-source voltage for junction gate JG1. $V_T(V_{JG1S}, V_{JG2S})$ denotes the threshold voltage of the $G^4$-FET corresponding to the flatband condition at the front interface, and its functional dependence upon $V_{JG1S}$ and $V_{JG2S}$ is displayed.

For the case where $V_{JG1S}=V_{JG2S}\equiv V_{JGS}$, the functional dependence of $V_T$ upon $V_{JGS}$ in the fully depleted mode has been modeled in K. Akarvardar, et al., "Threshold Voltage Model of the SOI 4-gate Transistor," IEEE Int. SOI Conf., pp. 89-90, 2004, as $$V_T(V_{JGS})=V_{T0}+\xi V_{JGS}, \tag{3}$$

where $V_{T0}$ and $\xi$ are given in the cited reference. The coupling $\xi$ factor has been found to be a strong function of the device width, and depends weakly on the silicon film thickness. For the case $V_{JG1S} \neq V_{JG2S}$, systematic measurements suggest that $$V_T(V_{JG1S}, V_{JG2S}) = V_{T0} + \frac{\xi}{2}(V_{JG1S} + V_{JG2S}). \quad (4)$$

Figure 1B:
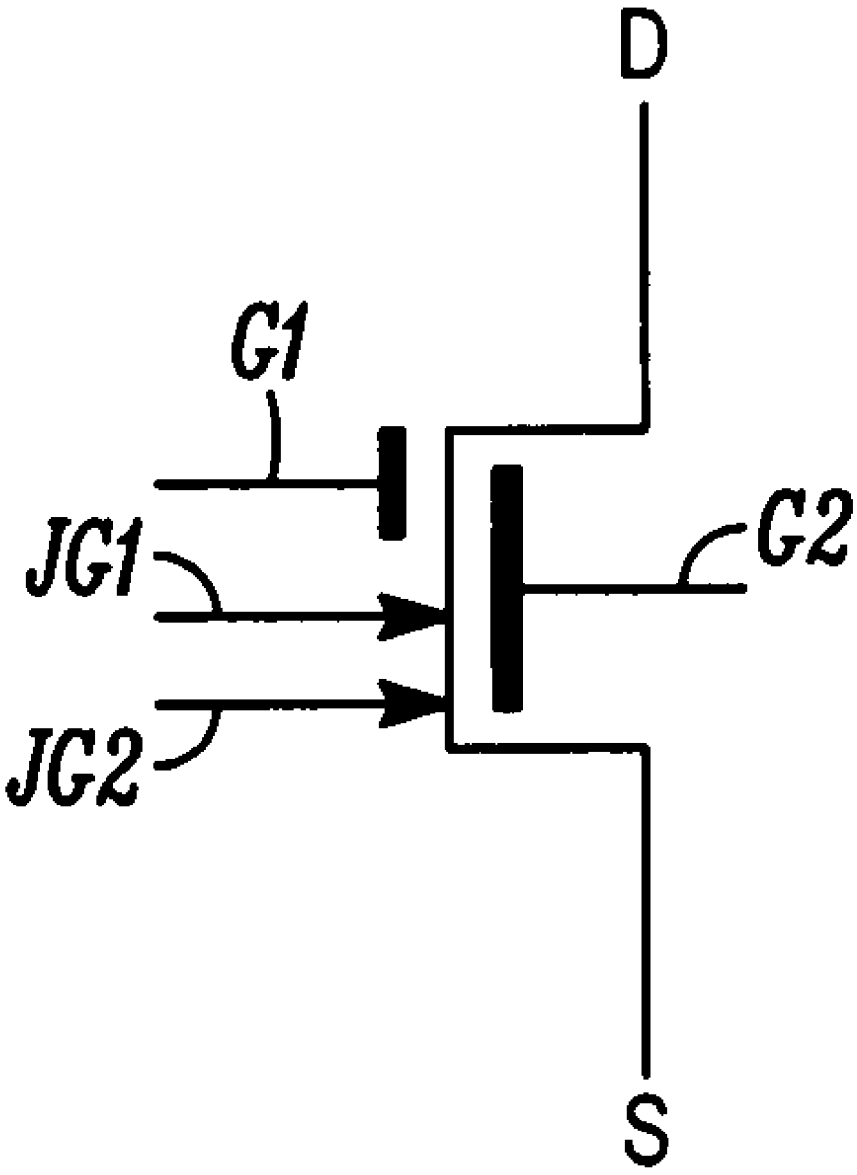
(PRIOR ART) FIG. 1B
FIG. 1B illustrates its circuit symbol.

FIG. 1B illustrates a circuit symbol for the n-channel $G^4$-FET of FIG. 1A. The choice of placing JG1 "above" JG2, as well as the ordering of the front gate, in FIG. 1B is only a matter of convenience.

Figure 2:
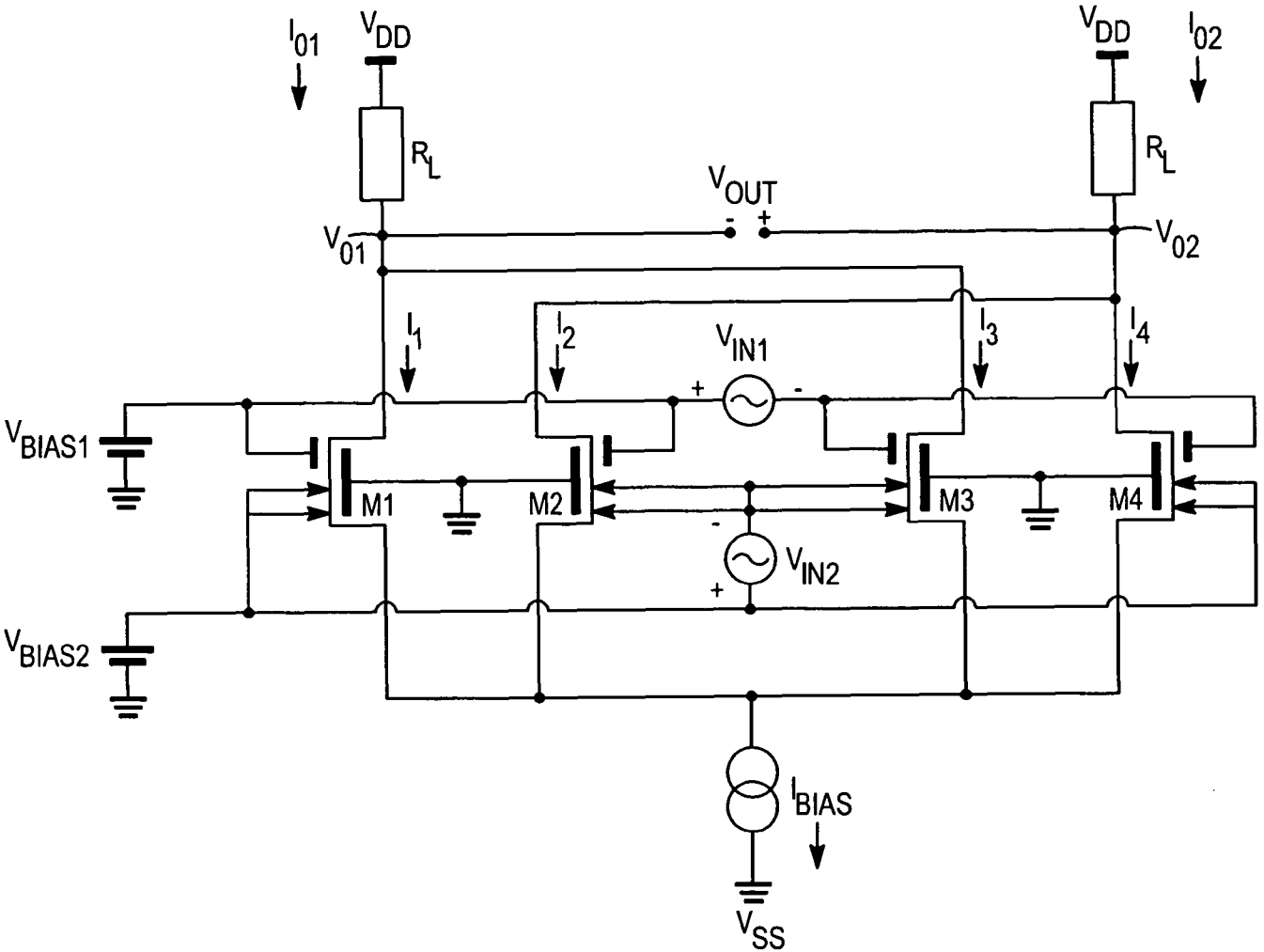
FIG. 2 is an analog multiplier circuit according to an embodiment of the present invention.

FIG. 2 illustrates an analog multiplier circuit according to an embodiment of the present invention. The four transistors labeled M1, M2, M3, and M4 are each a $G^4$-FET, each with its back gate (G2) grounded (at substrate potential $V_{SS}$). Transistors M1 and M3 have their drains connected to each other and loaded by a load, labeled $R_L$. For some embodiments, the load may be a resistor having a resistance $R_L$, and for others, the load may be an active device or circuit having a small-signal impedance $R_L$. The symbol Transistors M2 and M4 also have their drains connected to each other and loaded by a load having the same resistance (or small-signal impedance) value as the load for transistors M1 and M3. Because these loads are matched, the same label is used for each. These loads convert a differential current to a differential output voltage, denoted as $V_{OUT}$ in FIG. 2. The sources of the four transistors are connected to a current source that provides a bias current $I_{BIAS}$.

The two input voltages are denoted as $V_{IN1}$ and $V_{IN2}$. The front gates (G1) of transistors M1 and M2 are held at bias voltage $V_{BIAS1}$. The difference in voltages between the front gates of transistors M3 and M1 is $-V_{IN1}$ using the algebraic sign convention implied in FIG. 2. Likewise, the difference in voltages between the front gates of transistors M4 and M2 is $-V_{IN1}$. The two junction gates (JG1 and JG2) for each transistor are connected to each other. The two junction gates for transistor M1, and the two junction gates for transistor M4, are held at bias voltage $V_{BIAS2}$. Consequently, the difference in voltages between the junction gates of transistors M3 and M1 is $-V_{IN2}$, and the difference in voltages between the junction gates of transistors M4 and M2 is $V_{IN2}$.

The output voltage is given by $$V_{OUT} = [(I_1 + I_3) - (I_2 + I_4)]R_L, \quad (5)$$

where $I_1$, $I_2$, $I_3$, and $I_4$ denote the source-drain currents of transistors M1, M2, M3 and M4, respectively. Because each transistor has its two junction gate-to-source voltages equal to each other, Eq. (3) is applicable. Using Eq. (3) and Eq. (1) to provide expressions for the source-drain currents in Eq. (5), yields $$V_{OUT} = -4K_n \xi R_L V_{IN1} V_{IN2}, \quad (6)$$

indicating that the output voltage is a linear function of the product of the input voltages.

Figure 3:
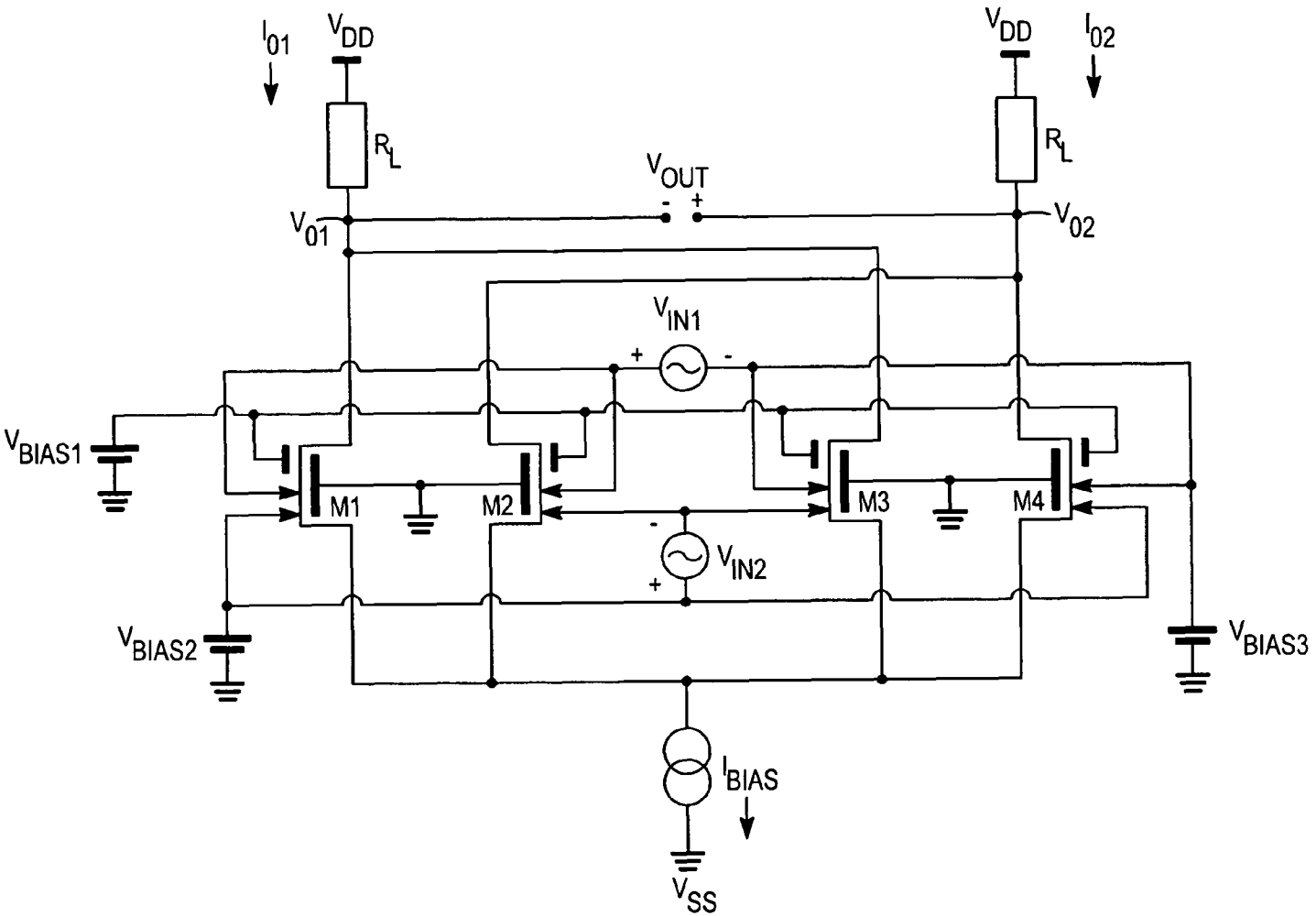
FIG. 3 is an analog multiplier circuit according to another embodiment of the present invention.

FIG. 3 illustrates a multiplier circuit according to another embodiment of the present invention. In the particular embodiment of FIG. 3, the front gate of each transistor is biased to bias voltage $V_{BIAS1}$. Using the convention of placing the junction gate JG1 "above" JG2 as in FIG. 1B, reference may be made to the junction gates in FIG. 3. Junction gates JG1 for transistors M3 and M4 are biased at bias voltage $V_{BIAS3}$. Junction gates JG2 for transistors M1 and M4 are biased at bias voltage $V_{BIAS2}$. With the input voltage $V_{IN1}$ as shown in FIG. 3, the difference in voltages between the junction gates JG1 of transistors M3 and M1 is $-V_{IN1}$, and the difference in voltages between the junction gates JG1 of transistors M4 and M2 is $-V_{IN1}$. With the input voltage $V_{IN2}$ as shown in FIG. 3, the difference in voltages between the junction gates JG2 of transistors M3 and M1 is $-V_{IN2}$, and the difference in voltages between the junction gates JG2 of transistors M4 and M2 is $V_{IN2}$.

If $V_{BIAS2} \neq V_{BIAS3}$, Eq. (4) is used instead of Eq. (3) as for the previous embodiment to derive an expression for the output voltage. It may then be shown that $$V_{OUT} = K_n \xi^2 R_L V_{IN1} V_{IN2}. \quad (7)$$

From Eq. (7), it is seen that the output voltage for the embodiment of FIG. 3 is also a linear function of the product of the input voltages, but with a different multiplier gain than for the embodiment of FIG. 2.

The embodiments should be designed so that the drain currents of the $G^4$-FETs satisfy (at least approximately) the expression of Eq. (1). For example, the biasing of the n-channels should be such that there is (1) cut-off prevention: $V_{G1S} > V_T(V_{JG1S}, V_{JG2S})$; (2) drain current saturation: $V_{G1D} \leqq V_T(V_{JG1S}, V_{JG2S})$; and (3) reverse-bias on the junction gates with respect to the source: $V_{JG1S} \leqq 0$ and $V_{JG2S} \leqq 0$. The "D" in the subscript of a voltage denotes drain, so that $V_{G1D}$ is the gate-to-drain voltage for the front gate (G1). The third condition is valid if the body of a $G^4$-FET is fully-depleted. If the body is partially-depleted, the requirement may be more strict: $V_{JG1S}$ and $V_{JG2S}$ should be sufficiently negative to keep the body fully-depleted during operation.

The expressions below are useful for finding an input range of the input voltages such that the above three conditions may be satisfied. To that end, the common source voltage for the circuit of FIG. 2 may be expressed as $$V_S = V_{BIAS1} - \xi V_{BIAS2} - V_{T0} - \sqrt{\frac{I_{BIAS}}{2K_n} - (V_{IN1}^2 + \xi^2 V_{IN2}^2)}, \quad (8A)$$

and the common source voltage for the circuit of FIG. 3 may be expressed as $$V_S = V_{BIAS1} - \xi V_{BIAS2} - V_{T0} - \sqrt{\frac{I_{BIAS}}{2K_n} - \frac{\xi^2}{4}(V_{IN1}^2 + V_{IN2}^2)}. \quad (8B)$$

Let $V_{O1}$ and $V_{O2}$ denote the voltages at the loads, as indicated in FIGS. 2 and 3, and let $I_{O1}$ and $I_{O2}$ denote the currents through the loads, as indicated in FIGS. 2 and 3. Note that $V_{O1}$ is the drain voltage of the transistor pair M1 and M3, and $V_{O2}$ is the drain voltage of the transistor pair M2 and M4. The current $I_{O1}$ is the sum of the drain currents of the transistor pair M1 and M3, and the current $I_{O2}$ is the sum of the drain currents of the transistor pair M2 and M4. Using Eqs. (8A) and (8B) for the source voltage in expressions for the drain currents for the circuit of FIG. 2 yields, $$V_{O1} = V_{DD} - \frac{I_{BIAS} R_L}{2} + 2K_n R_L \xi V_{IN1} V_{IN2}, \quad (9A)$$

and $$V_{O2} = V_{DD} - \frac{I_{BIAS} R_L}{2} - 2K_n R_L \xi V_{IN1} V_{IN2}. \quad (9B)$$

For the circuit of FIG. 3, $$V_{O1} = V_{DD} - \frac{I_{BIAS} R_L}{2} - \frac{K_n R_L \xi^2}{2} V_{IN1} V_{IN2}, \tag{10A}$$

and $$V_{O1} = V_{DD} - \frac{I_{BIAS} R_L}{2} - \frac{K_n R_L \xi^2}{2} V_{IN1} V_{IN2}. \tag{10B}$$

With the help of Eqs. (8A), (8B), (9A), (9B), (10A), and (10B), the G4-FET terminal voltages, $V_{G1}$, $V_{JG1}$, $V_{JG2}$, and $V_{G2}$, may be expressed as a function of the input voltages. These expressions may be applied to the previously described three conditions for the drain currents of the $G^4$-FETs to satisfy the expression of Eq. (1). It has been found that in many applications, for the same circuit and device parameters, the embodiment of FIG. 3 allows for a higher input range than the embodiment of FIG. 2. On the other hand, for the same input range, the circuit of FIG. 2 provides a larger output swing as may be noticed by comparing Eqs. (6) and (7), where it is assumed that the coupling factor $\xi$ is in the range of −1 to 0. Consequently, the circuits of FIGS. 2 and 3 allow one to tradeoff input range with output range for a given application.

Various modifications may be made to the described embodiments without departing from the scope of the invention as claimed below. For example, single-ended circuits may be employed, where there is only one pair of four-gate transistors instead of two pairs. For example, some embodiments may employ the pair of transistors M1 and M3 and its load, but not the pair of transistors M2 and M4 and its load. In that case, the single-ended voltage output is taken at the load of transistors M1 and M3. In other embodiments, dual circuits may be provided, where p-channel $G^4$-FETs are used instead of n-channel transistors.

In some embodiments, the input voltages may be derived in ways other than suggested in FIGS. 2 and 3. For example, referring to FIG. 3, in general a differential voltage may be provided to the front gates of transistors M1 and M3, so that a voltage $V_1$ is applied to the front gate of transistor M1, and a voltage $V_3$ is applied to the front gate of transistor M3, where these voltages have some common-mode voltage $V_{com}$. In the noiseless case, one may express these voltages as $V_1=V_{com}+v/2$ and $V_3=V_{com}-v/2$, where v is a small-signal voltage. Similar remarks apply to the differential voltages provided to the front gates of transistor pair M2 and M4, and to the junction gates of transistor pair M1 and M3, and transistor pair M2 and M4.

It is to be understood in these letters patent that the meaning of "A is connected to B", where A or B may be, for example, a node or device terminal, is that A and B are connected to each other so that the voltage potentials of A and B are substantially equal to each other. For example, A and B may be connected together by an interconnect (transmission line). In integrated circuit technology, the interconnect may be exceedingly short, comparable to the device dimension itself. For example, the gates of two transistors may be connected together by polysilicon, or copper interconnect, where the length of the polysilicon, or copper interconnect, is comparable to the gate lengths. As another example, A and B may be connected to each other by a switch, such as a transmission gate, so that their respective voltage potentials are substantially equal to each other when the switch is ON.

It is also to be understood in these letters patent that the meaning of "A is coupled to B" is that either A and B are connected to each other as described above, or that, although A and B may not be connected to each other as described above, there is nevertheless a device or circuit that is connected to both A and B. This device or circuit may include active or passive circuit elements, where the passive circuit elements may be distributed or lumped-parameter in nature. For example, A may be connected to a circuit element that in turn is connected to B.

It is also to be understood in these letters patent that a "current source" may mean either a current source or a current sink. Similar remarks apply to similar phrases, such as, "to source current".

It is also to be understood in these letters patent that various circuit components and blocks, such as current mirrors, amplifiers, etc., may include switches so as to be switched in or out of a larger circuit, and yet such circuit components and blocks may still be considered connected to the larger circuit.

What is claimed is:

1. A single-ended multiplier circuit comprising:

a current source having one terminal connected to a first reference voltage and a second terminal;

a load having one terminal connected to a second reference voltage and a second terminal configured as a single-ended output terminal;

a first $G^4$-FET comprising a front gate, a back gate, a first junction gate, a second junction gate, a source, and a drain; and a second $G^4$-FET comprising a front gate, a back gate, a first junction gate, a second junction gate, a source, and a drain;

the first and second junction gates of the first $G^4$-FET are connected to each other; the back gates of the first and second $G^4$-FETs are connected to each other; the first and second junction gates of the second $G^4$-FET are connected to each other; the sources of the first and second $G^4$-FETs are connected to the second terminal of the current source; and the drains of the first and second $G^4$-FETs are connected to the second terminal of the load;

the single-ended multiplier circuit configured to provide as an output a signal proportional to a product of a first input voltage difference applied to the front gates of the first and second $G^4$-FETs and a second input voltage difference applied to the first junction gates of the first and second $G^4$-FETs.

2. The circuit as set forth in claim 1, wherein the front gate of the first $G^4$-FET is biased at a first bias voltage; and the first and second junction gates of the first $G^4$-FET are biased at a second bias voltage.

3. The circuit as set forth in claim 1, wherein said first differential voltage applied to the front gates of the first and second $G^4$-FETs having a first common-mode voltage; and said second differential voltage is applied to the first junction gates of the first and second $G^4$-FETs having a second common-mode voltage.

4. The circuit as set forth in claim 1, wherein the load comprises a resistor.

5. A single-ended multiplier circuit comprising:

a current source having one terminal connected to a first reference voltage and a second terminal;

a load having one terminal connected to a second reference voltage and a second terminal configured as a single-ended output terminal;

a first $G^4$-FET comprising a front gate, a back gate, a first junction gate, a second junction gate, a source, and a drain; and a second $G^4$-FET comprising a front gate, a back gate, a first junction gate, a second junction gate, a source, and a drain;

the front gates of the first and second $G^4$-FETs are connected to each other;

the back gates of the first and second $G^4$-FETs are connected to each other; the sources of the first and second $G^4$-FETs are connected to the current source; and the drains of the first and second $G^4$-FETs are connected to the load;

the single-ended multiplier circuit configured to provide as an output a signal proportional to a product of a first input voltage difference applied to the first junction gates of the first and second $G^4$-FETs and a second input voltage difference applied to the second junction gates of the first and second $G^4$-FETs.

6. The circuit as set forth in claim 5, wherein the front gates of the first and second $G^4$-FETs are biased at a first bias voltage; the second junction gate of the first $G^4$-FET is biased at a second bias voltage; and the first junction gate of the second $G^4$-FET is biased at a third bias voltage.

7. The circuit as set forth in claim 5, wherein said first differential voltage is applied to the first junction gates of the first and second $G^4$-FETs having a first common-mode voltage; and said second differential voltage is applied to the second junction gates of the first and second $G^4$-FETs having a second common-mode voltage.

8. The circuit as set forth in claim 5, wherein the load comprises a resistor.

9. A four quadrant multiplier circuit for multiplying two input voltages, comprising:

a power terminal and a common terminal configured to receive respective reference voltages;

first, second, third, and fourth $G^4$-FETs, each of said four $G^4$-FETs having a front gate, a back gate, a first junction gate, a second junction gate, a source terminal, and a drain terminal, each back gate of each of said four $G^4$-FETs electrically coupled to said common terminal;

said source terminals of said first, second, third, and fourth $G^4$-FETs electrically coupled together and coupled to said common terminal by way of a current source;

said front gates of said first and second $G^4$-FETs coupled together, said coupled front gates of said first and second $G^4$-FETs representing a first input terminal of a first voltage input;

said front gates of said third and fourth $G^4$-FETs coupled together, said coupled front gates of said third and fourth $G^4$-FETs representing a second input terminal of said first voltage input;

said first and second junction gates of said first $G^4$-FET and said first and second junction gates of said fourth $G^4$-FET all coupled together and representing a first input terminal for a second voltage input;

said first and second junction gates of said second $G^4$-FET and said first and second junction gates of said third $G^4$-FET all coupled together and representing a second input terminal for said second voltage input;

said drain terminals of said second and said fourth $G^4$-FETs coupled together, and electrically connected to said power terminal by way of a first load, said coupled drain terminals of said second and said fourth $G^4$-FETs representing a first output terminal for an output voltage; and said drain terminals of said first and said third $G^4$-FETs coupled together, and electrically connected to said power terminal by way of a second load, said coupled drain terminals of said first and said third $G^4$-FETs representing a second output terminal for an output voltage;

said four quadrant multiplier circuit configured to receive a first input voltage signal across said first and second terminals of said first voltage input and configured to receive a second input voltage signal across said first and second terminals of said second voltage input, and configured to provide an output voltage across said first and second output terminals, said output voltage proportional to a product of said first input voltage and said second input voltage.

10. The four quadrant multiplier circuit of claim 9, wherein said front gates of said first and second $G^4$-FETs are coupled to a first bias voltage and said junction gates of said first and fourth $G^4$-FETs are coupled to a second bias voltage.

11. The four quadrant multiplier circuit of claim 10, wherein at least one of said bias voltages is configured to prevent a $G^4$-FET cut-off over a desired range of input voltages.

12. The four quadrant multiplier circuit of claim 10, wherein at least one of said bias voltages is configured to prevent a drain current saturation over a desired range of input voltages.

13. The four quadrant multiplier circuit of claim 10, wherein at least one of said bias voltages is configured to provide a reverse-bias on at least two of said junction gates with respect to said sources.

14. The four quadrant multiplier circuit of claim 13, wherein at least one of said bias voltages is configured to be sufficiently negative to keep a body of said $G^4$-FETs fully-depleted during operation of said four quadrant multiplier circuit.

15. The four quadrant multiplier circuit of claim 9, wherein at least one of said first load and second load comprises a resistor.

16. The four quadrant multiplier circuit of claim 9, wherein at least one of said first load and second load comprises an active device.

17. A four quadrant multiplier circuit for multiplying two input voltages, comprising:

a power terminal and a common terminal configured to receive respective reference voltages;

first, second, third, and fourth $G^4$-FETs, each of said four $G^4$-FETs having a front gate, a back gate, a first junction gate, a second junction gate, a source terminal, and a drain terminal, each back gate of each of said four $G^4$-FETs electrically coupled to said common terminal;

said source terminals of said first, second, third, and fourth $G^4$-FETs electrically coupled together and coupled to said common terminal by way of a current source;

said front gates of said first, second, third and fourth $G^4$-FETs coupled together;

said first junction gates of said first and second $G^4$-FETs coupled together, said coupled first junction gates of said first and second $G^4$-FETs representing a first input terminal of a first voltage input;

said first junction gates of said third and fourth $G^4$-FETs coupled together, said coupled first junction gates of said third and fourth $G^4$-FETs representing a second input terminal of said first voltage input;

said second junction gates of said first and fourth $G^4$-FETs coupled together, said coupled second junction gates of said first and fourth $G^4$-FETs representing a first input terminal of a second voltage input;

said second junction gates of said second and third $G^4$-FETs coupled together, said coupled second junction gates of said second and third $G^4$-FETs representing a second input terminal of said second voltage input;

said drain terminals of said second and said fourth $G^4$-FETs coupled together, and electrically connected to said power terminal by way of a first load, said coupled drain terminals of said second and said fourth $G^4$-FETs representing a first output terminal for an output voltage; and said drain terminals of said first and said third $G^4$-FETs coupled together, and electrically connected to said power terminal by way of a second load, said coupled drain terminals of said first and said third $G^4$-FETs representing a second output terminal for an output voltage;

said four quadrant multiplier circuit configured to receive a first input voltage signal across said first and second terminals of said first voltage input and configured to receive a second input voltage signal across said first and second terminals of said second voltage input, and configured to provide an output voltage across said first and second output terminals, said output voltage proportional to a product of said first input voltage and said second input voltage.

18. The four quadrant multiplier circuit of claim 17, wherein said front gates of said $G^4$-FETs are coupled to a first bias voltage, said second junction gates of said first and fourth $G^4$-FETs are coupled to a second bias voltage, and said first junction gates of said third and fourth $G^4$-FETs are coupled to a third bias voltage.

19. The four quadrant multiplier circuit of claim 18, wherein at least one of said bias voltages is configured to keep a body of said $G^4$-FETs fully-depleted during operation of said four quadrant multiplier circuit.

20. The four quadrant multiplier circuit of claim 18, wherein at least one of said bias voltages is configured to prevent a $G^4$-FET cutoff or is configured to prevent a drain current saturation over a desired range of input voltages.

* * * * *